US008733437B2

(12) United States Patent
Ware et al.

(10) Patent No.: US 8,733,437 B2
(45) Date of Patent: May 27, 2014

(54) APPARATUS AND METHODS FOR RECOVERY OF HYDROCARBONS

(75) Inventors: Charles H. Ware, Palm Harbor, FL (US); Sharon Mayes, legal representative, Palm Harbor, FL (US); Myron I. Kuhlman, Houston, TX (US); Marvin J. Schneider, League City, TX (US); Norman W. Hein, Jr., Midland, TX (US); Anthony Gus Castrogiovanni, Manorville, NY (US); Allen R. Harrison, Houston, TX (US)

(73) Assignee: World Energy Systems, Incorporated, Fort Worth, TX (US)

( * ) Notice: Subject to any disclaimer, the term of this patent is extended or adjusted under 35 U.S.C. 154(b) by 0 days.

(21) Appl. No.: 13/560,742

(22) Filed: Jul. 27, 2012

(65) Prior Publication Data

US 2013/0180708 A1 Jul. 18, 2013

Related U.S. Application Data

(60) Provisional application No. 61/512,085, filed on Jul. 27, 2011.

(51) Int. Cl.
*E21B 43/22* (2006.01)
*E21B 43/24* (2006.01)

(52) U.S. Cl.
USPC ..... 166/246; 166/52; 166/57

(58) Field of Classification Search
None
See application file for complete search history.

(56) References Cited

U.S. PATENT DOCUMENTS

| | | | | |
|---|---|---|---|---|
| 4,400,209 | A | 8/1983 | Kudo et al. | |
| 4,574,886 | A | 3/1986 | Hopkins et al. | |
| 4,597,441 | A | 7/1986 | Ware et al. | |
| 4,706,751 | A | 11/1987 | Gondouin | |
| 6,016,868 | A * | 1/2000 | Gregoli et al. | 166/261 |
| 7,770,646 | B2 | 8/2010 | Klassen et al. | |
| 8,091,625 | B2 | 1/2012 | Ware et al. | |
| 8,091,636 | B2 | 1/2012 | Kuhlman | |
| 2003/0173078 | A1 * | 9/2003 | Wellington et al. | 166/250.07 |
| 2007/0039736 | A1 * | 2/2007 | Kalman et al. | 166/302 |
| 2007/0193748 | A1 | 8/2007 | Ware et al. | |
| 2008/0083536 | A1 * | 4/2008 | Cavender et al. | 166/302 |
| 2008/0289821 | A1 * | 11/2008 | Betzer Tsilevich | 166/272.3 |
| 2010/0126727 | A1 | 5/2010 | Vinegar et al. | |
| 2011/0036575 | A1 | 2/2011 | Cavender et al. | |
| 2011/0214858 | A1 | 9/2011 | Castrogiovanni et al. | |
| 2011/0297374 | A1 | 12/2011 | Kuhlman et al. | |

OTHER PUBLICATIONS

International Search Report dated Oct. 16, 2012 for PCT/US/2012/048688 (WESI/0017 PCT).

* cited by examiner

*Primary Examiner* — George Suchfield
(74) *Attorney, Agent, or Firm* — Patterson & Sheridan, L.L.P.

(57) ABSTRACT

Embodiments of the invention described herein relate to methods and apparatus for recovery of viscous hydrocarbons from subterranean reservoirs. In one embodiment, a method for recovery of hydrocarbons from a subterranean reservoir is provided. The method includes drilling an injector well to be in communication with a reservoir having one or more production wells in communication with the reservoir, installing casing in the injector well, cementing the casing, perforating the casing, positioning a downhole steam generator in the casing, flowing fuel, oxidant and water to the downhole steam generator to intermittently produce a combustion product and/or a vaporization product in the reservoir, flowing injectants to the reservoir, and producing hydrocarbons through the one or more production wells.

26 Claims, 8 Drawing Sheets

APPARATUS AND METHODS FOR RECOVERY OF HYDROCARBONS

CROSS REFERENCE TO RELATED APPLICATIONS

This application claims benefit of U.S. Provisional Patent Application Ser. No. 61/512,085, filed Jul. 27, 2011, which application is hereby incorporated by reference herein.

BACKGROUND OF THE INVENTION

Field of the Invention

Embodiments of the invention relate to methods and apparatus for recovery of hydrocarbons from geological formations. More particularly, embodiments provided herein relate to recovery of viscous hydrocarbons from geological formations.

DETAILED DESCRIPTION

There are extensive hydrocarbon reservoirs throughout the world. Many of these reservoirs contain a hydrocarbon, often called "bitumen," "tar," "heavy oil," or "ultra heavy oil," (collectively referred to herein as "viscous hydrocarbon") which typically has viscosities in the range from 100 to over 1,000,000 centipoise. The high viscosity of these hydrocarbons makes it difficult and expensive to produce.

Each viscous hydrocarbon reservoir is unique and responds differently to the variety of methods employed to recover the hydrocarbons therein. Generally, heating the viscous hydrocarbon in-situ, to lower the viscosity thereof, has been employed to enhance recovery of these viscous hydrocarbons. Typically, these viscous hydrocarbon reservoirs would be produced with methods such as cyclic steam stimulation (CSS), steam drive (Drive), and steam assisted gravity drainage (SAGD), where steam is injected from the surface into the reservoir to heat the viscous hydrocarbon and reduce its viscosity enough for production.

However, some of these viscous hydrocarbon reservoirs are located under cold tundra or permafrost layers and may be located as deep as 1800 feet or more below the adjacent land surface. Current methods of production face limitations in extracting hydrocarbons from these reservoirs. For example, it is difficult, and impractical, to inject steam generated on the surface through permafrost layers in order to heat the underlying reservoir of viscous hydrocarbons, as the heat of the injected steam is likely to expand or thaw the permafrost. The expansion of the permafrost may cause wellbore stability issues and significant environmental problems, such as seepage or leakage of the recovered hydrocarbons at or below the wellhead.

Additionally, the current methods of producing viscous hydrocarbon reservoirs face other limitations. One such problem is wellbore heat loss of the steam, as the steam travels from the surface to the reservoir. Wellbore heat loss is also prevalent in offshore wells and this problem is exacerbated as the water depth and/or the well's reservoir depth increases. Where steam is generated and injected at the wellhead, the quality of the steam (i.e., the percentage of the steam which is in vapor phase) injected into the reservoir typically decreases with increasing depth as the steam cools on its journey from the wellhead to the reservoir, and thus the steam quality available downhole at the point of injection is much lower than that generated at the surface. This situation lowers the energy efficiency of the hydrocarbon recovery process and associated hydrocarbon production rates. Further, surface generated steam produces gases and by-products that may be harmful to the environment.

The use of downhole steam generators is known to address the shortcomings of injecting steam from the surface. Downhole steam generators provide the ability to produce steam downhole, prior to injection into the reservoir. Downhole steam generators, however, also present numerous challenges, including high temperatures, corrosion issues, and combustion instabilities. These challenges often result in material failures and thermal instabilities and inefficiencies.

Therefore, there is a continuous need for new and improved apparatus and methods for recovering heavy oil using downhole steam generation with improved thermal efficiency and minimal environmental impact.

SUMMARY OF THE INVENTION

Embodiments of the invention described herein relate to methods and apparatus for recovery of viscous hydrocarbons from subterranean reservoirs. In one embodiment, a method for recovery of hydrocarbons from a subterranean reservoir is provided. The method includes drilling an injector well to be in communication with a reservoir having one or more production wells in communication with the reservoir, installing casing in the injector well, cementing the casing, perforating the casing, positioning a downhole steam generator in the casing, flowing fuel, oxidant and water to the downhole steam generator to intermittently produce a combustion product and/or a vaporization product in the reservoir, flowing injectants to the reservoir, and producing hydrocarbons through the one or more production wells.

In another embodiment, a surface facility for recovering hydrocarbons is provided. The surface facility includes at least one production well and an injector well in communication with a subterranean reservoir, each of the at least one production well and the injector well having a wellhead and a wellbore extending into the subterranean reservoir, a first gas source and a second gas source positioned adjacent the injector well and coupled to a surface side of the wellhead of the injector well and in selective fluid communication with an inner bore of the wellbore of the injector well, and a fuel source and a water source positioned adjacent the injector well and coupled to the surface side of the wellhead of the injector well and in selective fluid communication with a downhole steam generator disposed in the inner bore of the wellbore of the injector well.

In another embodiment, a surface facility for recovering hydrocarbons is provided. The surface facility includes an injector well adjacent at least one production well extending into a subterranean reservoir, a gas source positioned adjacent the injector well, a fuel source and a water source in fluid communication with a burner assembly positioned in the injector well, and a separator unit in fluid communication with the production well and one or a combination of the fuel source and the water source to remove one of a gas or water from fluids flowing through the production well and flow the gas or water to the fuel source or the water source.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the invention relate to recovery of viscous hydrocarbons from subterranean reservoirs. Viscous hydrocarbons, as described herein, include hydrocarbons having viscosities in the range from about 100 centipoise (cP) to greater than about 1,000,000 cP. Embodiments of the invention as described herein may be utilized in subterranean reservoirs composed of non-porous or porous rock, such as shale, sandstone, limestone, carbonate, and combinations thereof. Embodiments of the invention may be utilized in enhanced oil recovery (EOR) techniques utilizing in-situ gas injection of a combustion product (e.g., hot gases) and/or a vaporization product (e.g., steam), chemical injection and/or in-situ flooding of chemical fluids (e.g., viscosity-reducing fluids such as carbon dioxide ($CO_2$), nitrogen (N2), oxygen ($O_2$), hydrogen ($H_2$), and combinations thereof), microbial and/or particulate injection, and combinations thereof. Embodiments of the invention provide a downhole steam generator for injecting the combustion product, steam and/or other injectants into the reservoirs. The downhole steam generator as described herein is gravity-independent and may perform combustion, vaporization, and/or injection reliably in horizontal wells, vertical wells, or any well orientation therebetween.

Figure 1:
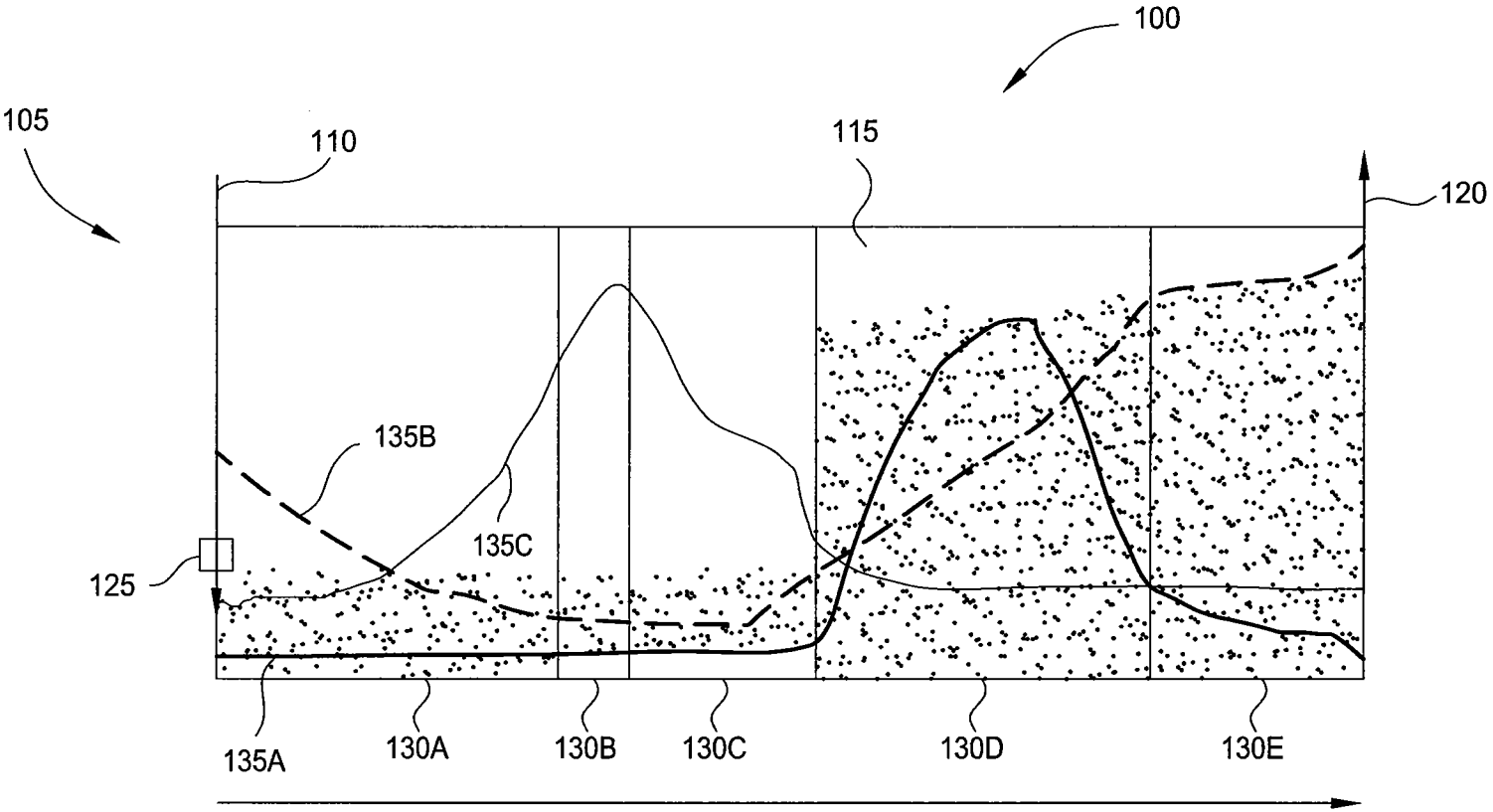
FIG. 1 is a schematic graphical representation of one embodiment of a reservoir management system.

FIG. 1 is a schematic graphical representation of one embodiment of a reservoir management system 100 utilizing embodiments described herein. The reservoir management system 100 includes an EOR delivery system 105 comprising at least a first injector well 110 in fluid communication with a hydrocarbon bearing reservoir 115. The reservoir management system 100 also includes at least a first producer well 120 that is in fluid communication with the reservoir 115 and/or the first injector well 110. The EOR delivery system 105 comprising the first injector well 110 includes a downhole steam generator (i.e., burner 125) that facilitates an engineered steam bank and facilitates formation of one or more advancing zones 130A-130E in the reservoir 115.

Various fluids such as fuel, an oxidant, and water or steam, are provided to the burner 125 to provide an exhaust in the reservoir 115 composed of steam and combustion by-products, which pressurize and heat the reservoir 115. The reservoir 115 is divided into zones 130A-130E and curves 135A-135C overlay each of the zones 130A-130E. Curve 135A represents the gas-hydrocarbon ratio (e.g., gas-to-oil ratio (GOR)) present in the reservoir 115, curve 1358 represents viscosity of the hydrocarbon in the reservoir 115, and curve 135C represents the temperature of the reservoir 115. The EOR delivery system 105 provides an exhaust from the burner 125 to pressurize and heat the reservoir 115 in order to move hydrocarbons in the reservoir 115 toward the producer well 120 as shown by the arrow.

The reservoir management system 100 shown in FIG. 1 is a snapshot in time and each of the zones 130A-130E are not limited spatially and/or temporally as depicted in the graphical representation of FIG. 1. Generally, zone 130A is a primary combustion region where initial pressurization is provided to the reservoir 115. Zone 130B is an active combustion region where the hydrocarbons in the reservoir 115 may be combusted and/or oxidized. Zone 130C comprises a region within the reservoir 115 where a steam front is formed. Zone 130D comprises a region of the reservoir where GOR may be the greatest. Zone 130E may be a region of the reservoir 115 where mobilized hydrocarbons are in proximity to the producer well 120 for recovery.

The burner 125 may be operable within an operating pressure range of about 300 pounds per square inch (psi) to about 1,500 psi, and up to for example 3,000 psi, or greater. The burner 125 may operate within a single pressure range or multiple pressure ranges, such as about 300 psi to about 3,000 psi, depending on the pressure of the producing reservoir. Operational depths of the EOR delivery system 105 include about 2,000 feet to about 10,000 feet. For example, operational depths of the EOR delivery system 105 include about 2,500 feet to about 8,500 feet at pressures of about 500 pounds per square inch absolute (psia) to about 2,500 psia. For example, steam from the EOR delivery system 105 at temperatures of about 500 degrees Fahrenheit (F) to about 650 degrees F. may be utilized in virgin reservoirs at depths of about 2,500 feet to about 5,500 feet and at a pressure of about 1,100 psia to about 2,500 psia. Steam from the EOR delivery system 105 at temperatures of about 425 degrees F. to about 625 degrees F. may be utilized in partially depleted reservoirs at depths of about 2,500 feet to about 8,500 feet and at a pressure of about 750 psia to about 2,500 psia. Gas mixes to the burner 125 may include enriched air (e.g., about 35% to about 95% $O_2$) as well as some fraction of a viscosity-reducing gas or gases in some embodiments. For example, an oxidant comprising enriched air may be provided to the burner 125 in a stoichiometric ratio such that a great portion of the oxidant is combusted. In another example, an oxidant comprising enriched air with an $O_2$ content greater than the stoichiometric ratio may be provided to the burner 125 to provide surplus $O_2$ in the reservoir 115. The surplus $O_2$ may be mixed with reduced-viscosity hydrocarbons within the reservoir 115 and combusted using the surplus $O_2$. In another example, an oxidant comprising about 95% $O_2$ may be combined with $CO_2$. This mixture may produce surplus $O_2$ that may be combusted with reduced-viscosity hydrocarbons within the reservoir 115. A portion of the surplus $CO_2$ may be separated from the recovered hydrocarbons and recycled.

Water may be supplied to the burner 125 at a flow rate required to generate the desired volume and quality of steam needed to optimize production from the reservoir 115. The flow rates may be as low as about 200 barrels per day (bpd) to about 1,500 bpd, or greater. The burner 125 may be operable to generate steam having a steam quality of about 0 percent to about 80 percent, or up to 100 percent. Water provided to the burner 125 may be purified to less than about one part per million (ppm) of total dissolved solids in order to produce higher quality steam. The burner 125 may be operable to generate steam downhole at a rate of about 750 bpd to about 3,000 bpd, or greater. The burner 125 is also capable of a wide range of flow rate and pressure turndown, such as ratios of about 16:1 to about 24:1. The burner 125 may be operable with a pressure turndown ratio of about 4:1, e.g. about 300 psi to about 1,200 psi, for example. A pressure turndown ratio of about 6:1 (up to about 1,800 psi or more) is possible. The burner 125 may be operable with a flow rate turndown ratio of about 4:1, e.g. about 375 bpd up to about 1,500 bpd or more of steam for example. The exhaust gases injected into the reservoir 115 using the burner 125 may include about 0.5 percent to about 5 percent excess oxygen.

The EOR delivery system 105 may be operable to inject heated viscosity-reducing gases, such as nitrogen ($N_2$) and/or carbon dioxide ($CO_2$), oxygen ($O_2$), and/or hydrogen ($H_2$), into the reservoir 115. $N_2$ and $CO_2$, both being a non-condensable gas (NCG), have relatively low specific heats and heat retention and will not stay hot very long once injected into the reservoir 115. At about 150 degrees C., $CO_2$ has a modest but beneficial effect on the hydrocarbon properties important to production, such as specific volume and oil viscosity. Early in the recovery process, the hot gases will transfer their heat to the reservoir 115, which aids in oil viscosity reduction. As the gases cool, their volume will decrease, reducing likelihood of override or breakthrough. The cooled gases will become more soluble, dissolving into and swelling the oil for decreased viscosity, providing the advantages of a "cold" NCG EOR regime. NCG's reduce the partial pressure of both steam and oil, allowing for increased evaporation of both. This accelerated evaporation of water delays condensation of steam, so it condenses and transfers heat deeper or further into the reservoir 115. This results in improved heat transfer and accelerated oil production using the EOR delivery system 105. The benefits of utilizing the burner 125 downhole may facilitate higher gas solubility, which further decreases viscosity, increases mobility, and accelerates oil production from the reservoir 115. For example, hot exhaust gases (e.g., steam, $CO_2$, and/or non-combusted $O_2$) from the burner 125 heats the oil in the reservoir as well as causing the viscosity of the oil in the reservoir to decrease. The heated gases thin the oil in the reservoir, which makes the oil more soluble to additional viscosity-reducing gases. The increased gas solubility may provide a further reduction in viscosity of the oil in the reservoir. The addition of the heated gases to the steam also results in a higher latent heat of the steam, and deeper (or greater) penetration of the steam into the reservoir 115 due to steam vapor pressure reduction. The combination accelerates oil production in the reservoir 115.

The volume of exhaust gas from the burner 125 may be around 3 thousand cubic feet (of gas) per barrel (Mcf/bbl) of steam or more, which may facilitate accelerated oil production in the reservoir 115. When the hot gas moves ahead of the oil it will quickly cool to reservoir temperature. As it cools, the heat is transferred to the reservoir, and the gas volume decreases. As opposed to a conventional low pressure regime, the gas volume, as it approaches the production well, is considerably smaller, which in turn reduces the likelihood of, and delays, gas breakthrough. For example, $N_2$ and $CO_2$, as well as other gases, may breakthrough ahead of the steam front, but at that time the gases will be at reservoir temperature. The hot steam from the EOR delivery system 105 will follow but will condense as it reaches the cool areas, transferring its heat to the reservoir, with the resultant condensate acting as a further drive mechanism for the oil. In addition, gas volume decreases at higher pressure (V is proportional to 1/P). Since the propensity of gas to override is limited at low gas saturation by low gas relative permeability, fingering is controlled and production of oil is accelerated.

The zone 130A is the volume of the reservoir 115 adjacent the injector well 110. The zone 130A may include a primary combustion region where initial pressurization is provided. As a result of this combustion, the temperature of the viscous hydrocarbon is increased, and its viscosity is decreased, in the zone 130A. After some processing time, the hydrocarbons in zone 130A will be depleted due to the steam front provided by the burner 125. The depletion of hydrocarbons in the zone 130A is due to one or a combination of movement of the hydrocarbons towards the producer well 120 and consumption of the hydrocarbons by combustion. For example, residual oil behind the steam front may be consumed by combustion with excess oxygen provided to the reservoir 115 during the EOR process. Zone 130B may include an active combustion region where temperature peaks and viscosity decreases. The temperature in the zone 130B may be about 300 degrees Celsius (C) to about 600 degrees C. in one embodiment. In the zone 130B, temperature reaches a peak which reduces the viscosity of the hydrocarbons. Surplus oxygen ($O_2$) may also be injected into the reservoir 115 by the burner 125 which may be utilized for in-situ oxidation of any residual oil that is bypassed by the steam front.

Zone 130C is a steam region where the steam front formed by the zones 130A and 130B may be found. Steam provided in the zone 130C moves towards the producer well 120, which helps reduce oil viscosity ahead of the zone 130C and also pushes hydrocarbons towards the producer well 120. In zone 130D, viscosity rises as the reservoir temperature decreases, but this is countered by the dissolution of cool NCG gases in the oil bank ahead of the steam front. This area reaches the highest GOR encountered in the reservoir 115. Temperatures in zone 130D may be about 100 degrees C. In zone 130E, the producer well 120 is surrounded by oil that has been pushed ahead of the combustion process and is at relatively high viscosity, compared to other higher temperature regions. However the viscosity is still much lower than at original reservoir conditions. In one aspect, the mobility of the hydrocarbons in the reservoir 115 is increased due to various heating regimes, interactions with viscosity-reducing gases, and other energy production and/or chemical reactions provided by the EOR delivery system 105. For example, the hydrocarbons and/or the reservoir 115 may be heated by direct heating from the burner 125 and/or combustion with residual hydrocarbons. In portions of the reservoir management system 100, free energy is released due to a phase change, which provides heat that is absorbed by the hydrocarbons and/or the reservoir 115. Further, viscosity of the hydrocarbons is reduced by interaction with viscosity-reducing gases that are provided to the reservoir by the EOR delivery system 105.

Figure 2A:
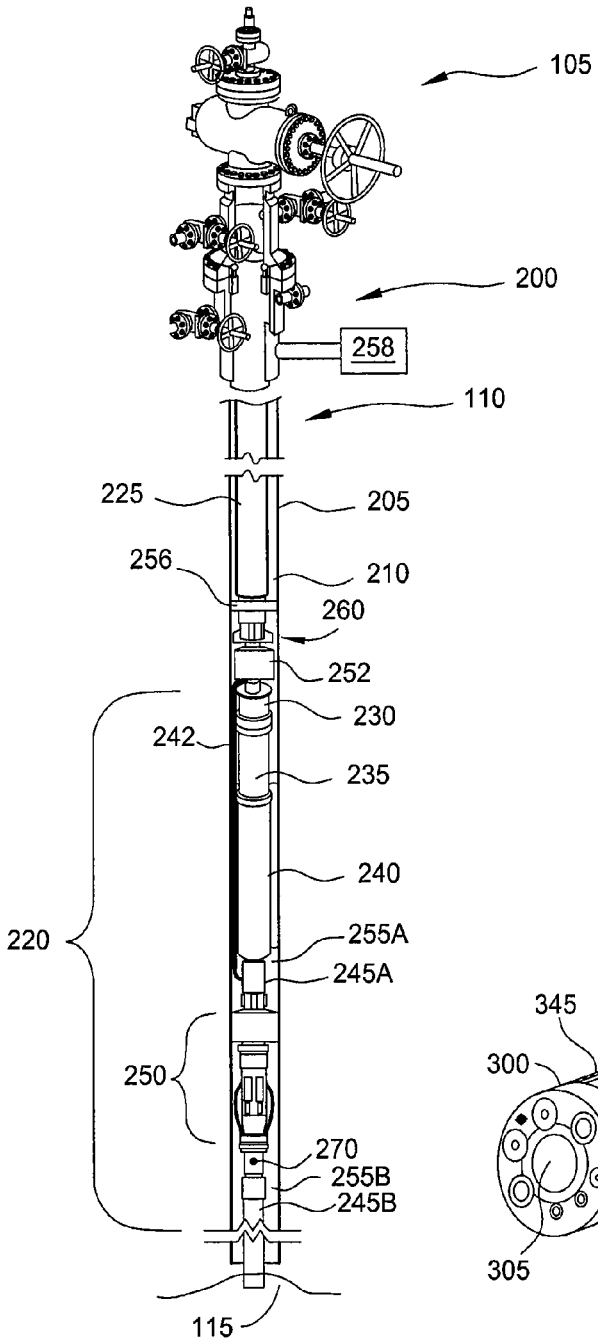
FIG. 2A is an isometric view of one embodiment of an enhanced oil recovery (EOR) delivery system that may be utilized in the reservoir of FIG. 1.
Figure 2B:
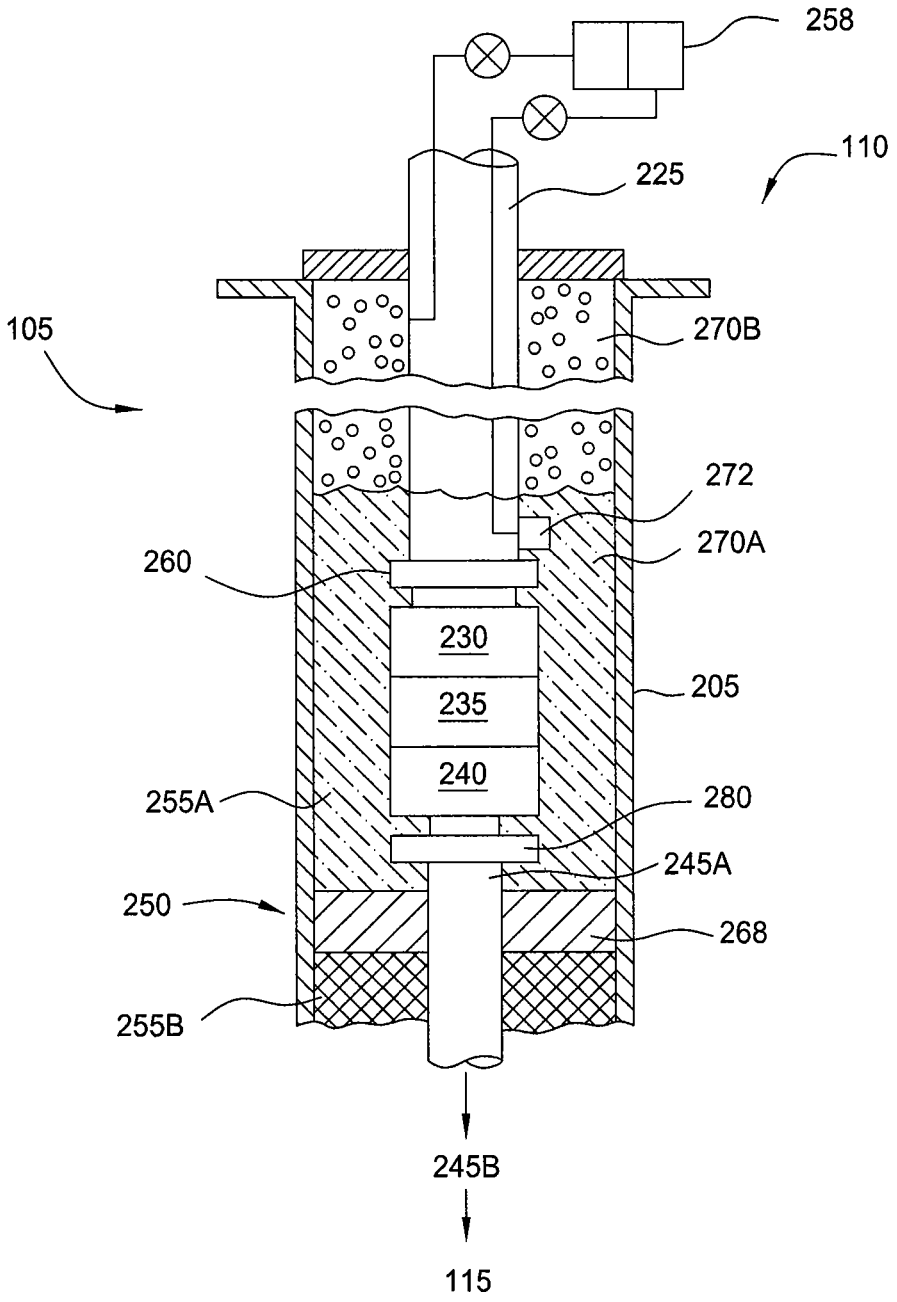
FIG. 2B is a schematic cross-sectional view of a portion of the EOR delivery system shown in FIG. 2A.

FIG. 2A is an isometric view of one embodiment of an EOR delivery system 105 that may be utilized in the reservoir 115 of FIG. 1. FIG. 2B is a schematic cross-sectional view of a portion of the EOR delivery system 105 shown in FIG. 2A. The EOR delivery system 105 includes a wellhead 200 coupled to an injector well 110. The injector well 110 includes a tubular casing 205 having an inner bore 210 (e.g., annulus). A downhole steam generator 220 is disposed in the inner bore 210 and may be at least partially supported by an umbilical device 225 extending downwardly in the casing 205 from the wellhead 200. The downhole steam generator 220 includes a burner head assembly 230 coupled to a combustion chamber 235. A vaporization chamber 240 is coupled to the combustion chamber 235. The umbilical device 225 also contains conduits and signal or control lines for operation and control of the downhole steam generator 220. Conduits for fluids, monitoring/control devices and signal transmission devices may be coupled to the umbilical device 225 or housed within the umbilical device 225. The monitoring/control devices include electronic sensors and actuators, valves that facilitate controlled fluid flow to the downhole steam generator 220. The signal transmission devices include telemetry systems for communication with the surface equipment and the monitoring/control devices. A mating flange 260 may be utilized to facilitate connections between the downhole steam generator 220 and the umbilical device 225. The mating flange 260 may be a quick connect/disconnect device suitable to support the weight of the downhole steam generator 220 while facilitating coupling of any fluid and/or electrical connections between the umbilical device 225 and the downhole steam generator 220. The umbilical device 225 may be configured to support the downhole steam generator 220 in the casing 205

In operation, fuel and an oxidant is provided to the downhole steam generator 220 to generate an exhaust gas. The fuel supplied to the burner head assembly 230 may include natural gas, syngas, hydrogen, gasoline, diesel, kerosene, or other similar fuels. The fuel and oxidant are ignited in the combustion chamber 235. In one mode of operation, the fuel is combusted in the downhole steam generator 220 to produce the exhaust gas without the production of steam. When steam is preferred as an exhaust gas, water, or in some instances saturated steam (i.e., a two-phase mixture of liquid water and steam), is provided to the vaporization chamber 240 where it is heated by the combustion of the fuel and oxidant in the combustion chamber 235 to produce high quality steam therein. The exhaust gas produced by the reaction in the downhole steam generator 220 flows through an upper tailpipe 245A and a lower tailpipe 245B before injection into the reservoir 115. Injectants, such as $O_2$, and other viscosity-reducing gases, such as $H_2$, $N_2$ and/or $CO_2$, as well as microbial particles, enzymes, catalytic agents, propants, markers, tracers, soaps, stimulants, flushing agents, nanoparticles, including nanocatylists, chemical agents or combinations thereof, may be provided to the downhole steam generator 220 and mixed with the exhaust gas, which is provided to the reservoir 115 through the lower tailpipe 245B. Alternatively, a liquid or gas, including but not limited to viscosity-reducing gases, microbial particles, nanoparticles, or combinations thereof, may be injected into the reservoir 115 through the combustion chamber 235 when the downhole steam generator 220 is not producing steam. Alternatively or additionally, injectants, such as $O_2$, and other viscosity-reducing gases, such as $H_2$, $N_2$ and/or $CO_2$, as well as microbial particles, nanoparticles, or combinations thereof, may be provided to the reservoir 115 via the lower tailpipe 245B through a separate conduit 242 without introduction into the combustion chamber 235. The additional liquids, gases and other injectants may be flowed to the reservoir 115 while the downhole steam generator 220 is generating steam or when the downhole steam generator 220 is not generating steam. For example, the downhole steam generator 220 may provide steam generation and/or injectants to the reservoir 115 for a desired time period. At other time periods, the downhole steam generator 220 may not be used to generate steam while injectants are provided to the reservoir 115. The on/off cycles of steam generation and/or the cyclic use of injectants may be repeated, as necessary, to facilitate viscosity reduction and enhanced mobility of the oil in the reservoir 115.

In some embodiments, the downhole steam generator 220 includes a sealing device, such as a packer 250. The packer 250 may be utilized to bifurcate the inner bore 210 between a portion of the downhole steam generator 220 and the casing 205 into an upper volume 255A and a lower volume 255B. The packer 250 is utilized as a fluid and pressure seal. The packer 250 may also be utilized to support the weight of the downhole steam generator 220 in the injector well 110. As shown in FIG. 2B, the packer 250 includes an expandable portion 268 that facilitates sealing between the upper tailpipe 245A of the downhole steam generator 220 and the inner wall of the casing 205. In one aspect, the expandable portion 268 maintains pressure in the lower volume 255B (i.e., prevent escape of the steam/gases upwardly in the casing 205) as well as minimizing leakage between the upper volume 255A and the lower volume 255B of the casing 205.

In some embodiments, a liquid or a gas, may be provided from a fluid source 258 to flow a packer fluid 270A to the upper volume 255A. The packer fluid 270A may be utilized to conduct heat from the downhole steam generator 220. The packer fluid 270A may also facilitate minimizing pressure losses to the upper volume 255A from the reservoir 115. In one embodiment, the packer fluid 270A may be a liquid or a gas provided from a port 272 disposed on the umbilical device 225. The liquid or gas provided in the upper volume 255A may be pressurized to a pressure greater than the pressure in the lower volume 255B. While some portions of the casing 205 may be heated by combustion in the downhole steam generator 220, the packer fluid 270A conducts heat from the downhole steam generator 220, which may minimize heating of rock and/or permafrost that surrounds the casing 205. The packer 250 may also be utilized to prevent or fluid losses to the upper volume 255A of the inner bore 210 from the lower volume 255B. The packer 250 may be provided with the packer fluid 270A suitable to withstand temperatures generated by the use of the downhole steam generator 220. In one embodiment, the packer fluid 270A is a thermally conductive liquid with a high boiling point and viscosity. The packer fluid 270A may comprise brine, corrosion inhibitors, bromides, formates, halides, polymers, $O_2$ scavengers, anti-bacterial agents, or combinations thereof, as well as other liquids. Additionally, the packer fluid 270A may be flowed into and out of the upper volume 255A (i.e., circulated).

The fluid source 258 may facilitate heat exchange to remove heat from the packer fluid 270A prior to flowing the fluid into the upper volume 255A. In one embodiment, a dual-phase packer fluid may be used in the upper volume 255A. The dual-phase packer fluid includes the packer fluid 270A as well as a packer fluid 270B disposed above the packer fluid 270A. The packer fluid 270B may be a gas, such as $N_2$, an inert gas or gases, or combinations thereof. The packer fluid 270B may comprise a gas blanket disposed in the upper portion of the casing 205 for boiling point control (i.e., prevent boiling) of the packer fluid 270A. The packer fluid 270B may be provided to the upper volume 255A from the fluid source 258. The packer fluid 270B may be pressurized to a pressure greater than the pressure in the lower volume 255B. A latch 280 may be provided between the downhole steam generator 220 and the expandable portion 268. The latch 280 may be a temporary connector between the packer 250 and the upper tailpipe 245A of the downhole steam generator 220.

The latch 280 may be equipped with shear pins to facilitate disconnection of the downhole steam generator 220 when removing the downhole steam generator 220 from the injector well 110.

Over-pressuring the upper volume 255A is utilized to prevent leakage of liquids or gases from the lower volume 255B into the upper volume 255A. The liquid or gas provided in the upper volume 255A may, by thermal conduction, assist in cooling the upper section of the generator apparatus by drawing some thermal energy up away from the downhole steam generator 220 and dispersing it into the extended volume of the well above the downhole steam generator 220. This extended heat transfer may lower the temperature at the interface with the packer fluid to prevent boiling of the packer fluid when exposed to temperatures generated when the downhole steam generator 220 is in use. The gas provided in the upper volume 255A may be air, $N_2$, $CO_2$, helium (He), argon (Ar), other suitable coolant fluids, and combinations thereof. Alternatively or additionally, a heat sink 256 may be placed above the downhole steam generator 220 to dissipate the heat energy at the portion of the casing 205 proximate the upper end of the downhole steam generator 220. The heat sink 256 may be used to dissipate heat from the downhole steam generator 220 and/or supporting members that may be in thermal communication with the downhole steam generator 220. One or both of the coolant and the heat sink 256 are utilized to maintain a lower temperature on the upper end of the downhole steam generator 220. The heat sink 256 may be a combination of a solid, a liquid or gases, that is used to reduce the temperature of any equipment above the downhole steam generator 220. The EOR delivery system 105 may also include a block 252 that is positioned between the umbilical device 225 and the downhole steam generator 220. The block 252 may be a mass of dense material, such as a metal, that facilitates lowering of the downhole steam generator 220 into the casing 205. The downhole steam generator 220 may also include a sensor package 270. The sensor package 270 may include one or more sensors coupled to the downhole steam generator 220, including other portions of the EOR delivery system 105. The sensor package 270 may be utilized to monitor one or a combination of pressure, flow, viscosity, density, inclination, orientation, acoustics, fluid (gas or liquid) levels, and temperature within the injector well 110 to facilitate control of the downhole steam generator 220 and/or the EOR delivery system 105.

As an alternative completion process for the downhole steam generator 220, one or more strings of tubing may be utilized to lower the downhole steam generator 220 in the injector well 110. Fuel, oxidant and water may be provided to the downhole steam generator 220 through the one or more strings of tubing. Individual signal transmission devices, such as wires or optical fibers may be coupled to the downhole steam generator 220 and lowered into the injector well 110 to facilitate control of the downhole steam generator 220. In one aspect, only two tubing strings may be utilized. One tubing string may be used for the fuel and one tubing string may be used for the oxidant. Water may be provided to the inner bore 210 of the injector well 110 above the downhole steam generator 220. The water may be routed to the combustion chamber 235 for producing steam that is provided to the reservoir 115.

Figure 3A:
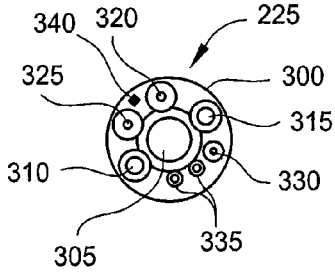
FIG. 3A is a cross-sectional view of the umbilical device of the EOR delivery system of FIG. 2.

FIG. 3A is a cross-sectional view of the umbilical device 225 of the downhole steam generator 220 of FIG. 2. The umbilical device 225 includes a cylindrical body 300 that is made from a rigid or semi-rigid material. The umbilical device 225 may be fabricated from metallic materials or plastic materials having physical properties that facilitate support of the downhole steam generator 220. Examples of the materials include steel, stainless steel, lightweight metallic materials, such as titanium, aluminum, as well as polymers or plastics, such as polyetheretherketones (PEEK), polyvinylchloride (PVC), and the like. The cylindrical body 300 includes a plurality of conduits for transfer of fluids and signals from surface sources to the downhole steam generator 220 (shown in FIG. 2). The body 300 includes a central conduit 305 and a plurality of peripheral conduits 310-335. Any combination of the peripheral conduits 310-335 may be selectively utilized in conjunction with the central conduit 305 to flow fluids to the downhole steam generator 220 and/or around the downhole steam generator 220 (i.e., to the lower volume 255B) for delivery to the reservoir 115. Additionally, in addition to flowing fluids to the downhole steam generator 220, one or more of the central conduit 305 and the peripheral conduits 310-335 may be utilized as a strength member utilized to support the downhole steam generator 220 in the injector well 110.

Figure 3B:
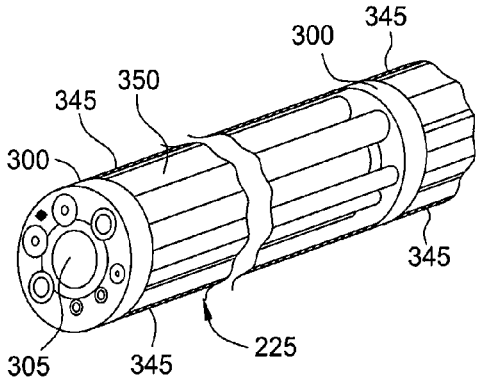
FIG. 3B is an isometric view of another embodiment of an umbilical device that may be utilized with the EOR delivery system of FIG. 2.

The central conduit 305 may be utilized to flow air, enriched air, oxygen, $CO_2$, $N_2$, or combinations thereof, to the downhole steam generator 220. The central conduit 305 may be utilized to supply an oxidant to the burner head assembly 230 to assist in the combustion and/or vaporization reaction in the downhole steam generator 220. Alternatively or additionally, the central conduit 305 may supply oxidizing gases in excess of the molar amount necessary for the combustion reaction in the downhole steam generator 220. In this manner, oxidizing gases, such as air, enriched air (air having about 35% oxygen), 95 percent pure oxygen, and combinations thereof. A first conduit 310 may be utilized for flowing a fuel gas or liquid to the burner head assembly 230. The fuel supplied to the burner head assembly 230 may include natural gas, syngas, hydrogen, gasoline, diesel, kerosene, or other similar fuels. A second conduit 315 may be utilized for flowing water, or saturated steam, to the vaporization chamber 240 of the downhole steam generator 220. A third conduit 320 and a fourth conduit 325 may be utilized for flowing a viscosity-reducing gas, such as $CO_2$, $N_2$, $O_2$, $H_2$, or combinations thereof, to the downhole steam generator 220 and/or the lower volume 255B of the inner bore 210. A fifth conduit 330 may be utilized for flowing particles to the downhole steam generator 220 and/or to the lower volume 255B of the inner bore 210. The particles may include catalysts, such as nanocatalysts, microbes, or other particles and/or viscosity reducing elements. One or more control conduits 335 may be provided on the body 300 for electrical signals controlling igniters (not shown) and/or valves (not shown) controlling fluid flow within the downhole steam generator 220. The control conduits 335 may be wires, optical fibers, or other signal carrying medium that facilitates signal communications between the surface and the downhole steam generator 220. A sensor 340 may also be provided in or on the body 300. The sensor 340 may be utilized to monitor one or a combination of pressure, flow, viscosity, density, inclination, orientation, acoustics, fluid (gas or liquid) levels, and temperature. For example, the sensor 340 may be utilized to determine temperatures within the casing 205, pressures within the casing 205, depth measurements, and combinations thereof. The umbilical device 225 may be a continuous rigid or semi-rigid (i.e., flexible) support member as shown in FIG. 2, or include a plurality of modular sections as shown in FIG. 3B. The modular sections may be coupled by one of more strength members 345 which may comprise a cable. In embodiments where the umbilical device 225 comprises two or more modular sections, the central conduit 305 and the peripheral conduits 310-335 may contain flexible conduits 350, such as tubes or hoses, to deliver fluids to the downhole steam generator 220 and/or to the lower volume 255B of the inner bore 210. In an alternative embodiment, any fluid conduits and/or control conduits may be individually coupled between the surface and the downhole steam generator 220 instead of being bundled within the umbilical device 225.

The downhole steam generator 220 may be dimensioned to fit within any typical production casing and/or liner. The downhole steam generator 220 may be dimensioned to fit casing diameters of about 5½ inch, about 7 inch, about 7⅝ inch, and about 9⅝ inch sizes, or greater. The downhole steam generator 220 may be about 8 feet in overall length. The diameter of the downhole steam generator 220 may be about 5.75 inches in one embodiment. The downhole steam generator 220 may be compatible with a packer 250 of about 7 inch to about 7⅝ inch, to about 9⅝ inch sizes. The downhole steam generator 220 may be made of carbon steel, or corrosion resistant materials such as stainless steel, nickel, titanium, combinations thereof and alloys thereof, as well as other corrosion resistant alloys (CRA's). The downhole steam generator 220 and the umbilical device 225 may be utilized in casing at about a 20 degree to 45 degree angle of inclination. However, the modular aspect of the umbilical device 225 and the compact size of the downhole steam generator 220 enables use of the EOR delivery system 105 in casing at any angle of inclination.

Figure 4:
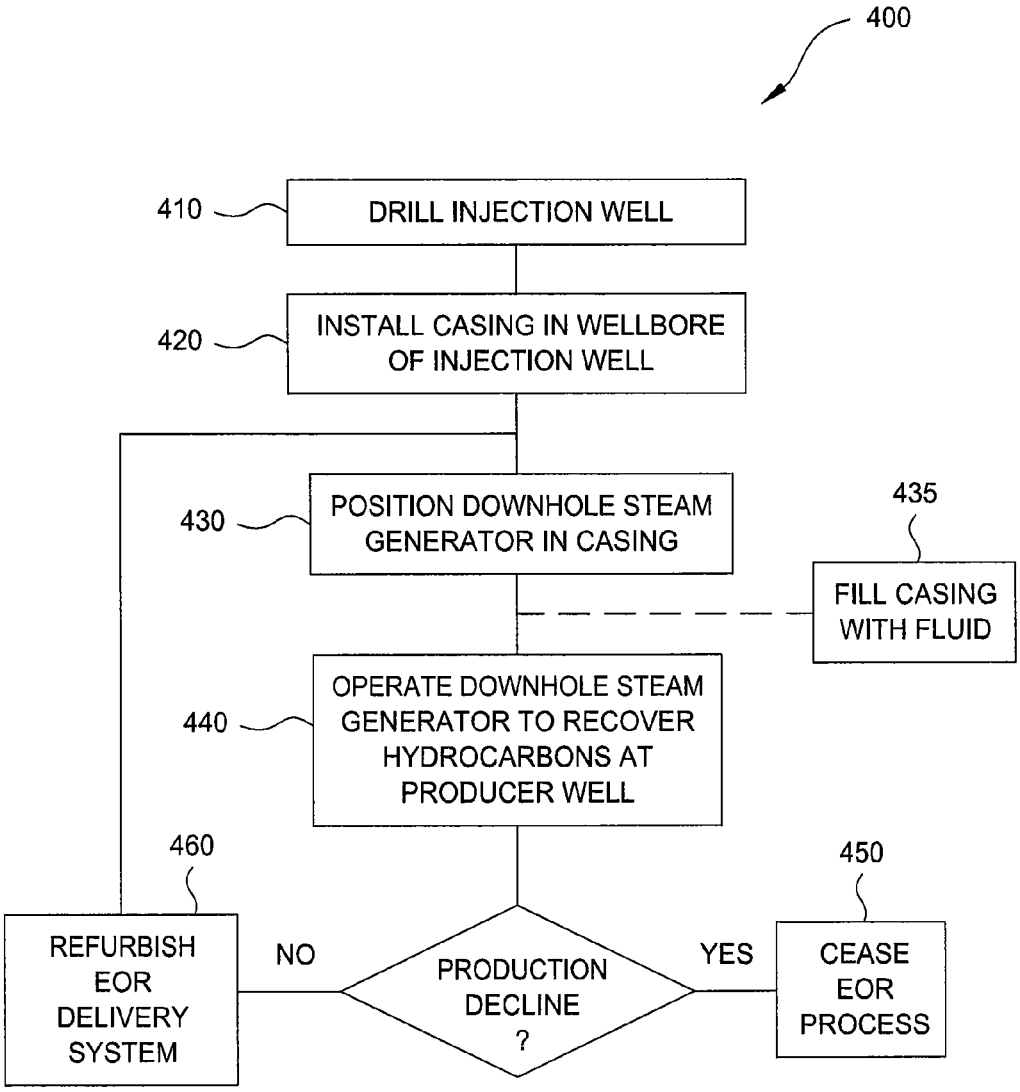
FIG. 4 is a flowchart depicting one embodiment of an installation/completion process that may be utilized with the EOR delivery system of FIG. 2.

FIG. 4 is a flowchart depicting one embodiment of an installation/completion process 400 that may be utilized with the EOR delivery system 105 of FIG. 2. Process 400 begins at step 410 which includes drilling an injection well in a reservoir adjacent to one or more production wells proximate the reservoir. Step 420 includes installing casing in the wellbore of the injection well. Installation of the casing may include cementing the wellbore. Installation of the casing may also include perforating the casing. Multiple options for casing and/or cementing are available to increase the longevity of the injector well. The casing may include two types of casing: casing consisting of corrosion resistant alloys (CRA's) and carbon steel casing without any corrosion resistance properties. The options will be explained below and depend on the location (i.e., depth) of the packer when the downhole steam generator 220 is later installed in the casing.

As one option, carbon steel casing may be utilized for the entire wellbore, with a portion of the casing proximate the depth location of the packer, and downstream therefrom, cemented in high temperature cement. This option may be the least expensive due to the costs of the carbon steel casing relative to CRA casing. This option may be utilized where the completion procedure is estimated to be short (less than about 2-3 years) as prolonged exposure of the carbon steel casing to the corrosive environment below the packer may cause the wellbore to prematurely fail.

As another option, carbon steel casing may be used from the surface to a location slightly upstream from the depth of the packer, and CRA casing may be run from that location to the bottom of the wellbore. The portion of the casing proximate the location of the packer, and downstream therefrom, may be cemented in high temperature cement. This option may require only about two joints (lengths) of CRA casing and the remainder being carbon steel casing. This option may provide longer usable life of the wellbore as the portion of the casing exposed to the corrosive environment below the packer is protected from corrosion. This option may also save costs as the majority of the wellbore consists of carbon steel casing.

Another option includes utilizing carbon steel casing from the surface to a location slightly upstream from the depth of the packer, and using carbon steel casing with a CRA cladding on the inside diameter of the carbon steel casing from that location to the bottom of the wellbore. The portion of the CRA clad carbon steel casing proximate the location of the packer, and downstream therefrom, may be cemented in high temperature cement. This option may provide longer usable life of the wellbore as the portion of the casing exposed to the corrosive environment below the packer is protected from corrosion by the CRA cladding. This option may also save costs as the wellbore consists of entirely of carbon steel casing with the portion proximate and below the packer having a CRA cladding, which is less expensive than CRA casing.

Step 430 includes positioning the downhole steam generator in the casing. Step 430 may include multiple run-ins. A first run-in may consist of positioning the packer in the wellbore. The packer may be set and actuated to bifurcate the inner bore 210 of the casing. A second run-in may consist of positioning the downhole steam generator uphole of the packer. During this step, the umbilical device will be attached to the downhole steam generator, which assists in supporting and positioning of the downhole steam generator. The downhole steam generator may include a section of tailpipe downstream of the vaporization chamber 240 (shown in FIG. 2) that couples to and forms a seal with an upstream portion of the packer. The seal is configured as a semi-permanent coupling between the tailpipe and the packer.

Step 440 includes operation of the downhole steam generator to facilitate viscosity reduction of the hydrocarbons in the reservoir. In one mode of operation, the downhole steam generator 220 provides heat and pressure to the reservoir via steam generation, production of hot exhaust gases, and/or fluid injection, with or without a combustion reaction in the downhole steam generator 220. For example, heat may be provided by steam generation in the downhole steam generator 220. In this mode of operation, steam, as well as exhaust gases, is flowed to the reservoir. In another example, heat may be provided by combusting fuel within the downhole steam generator 220 without steam production. This mode produces an exhaust gas that heats the reservoir. The exhaust gas may also be utilized for pressurization of the reservoir. Pressurization may also include flowing injectants, such as $H_2$, $N_2$ and/or $CO_2$, as well as microbial particles, enzymes, catalytic agents, propants, markers, tracers, soaps, stimulants, flushing agents, nanoparticles, including nanocatalysts, chemical agents or combinations thereof to the reservoir. In one example of operation, the injectants may be provided with or without steam and/or exhaust generation by the downhole steam generator 220. An optional step 435 may include filling the casing above the packer with a fluid to facilitate thermal insulation and/or maintenance of pressure in the casing annulus above the packer. A blanket gas may be used for additional pressure control.

After a time of operation during step 440, the downhole steam generator and/or the packer may need refurbishment. A target refurbishment time may be about three years of utilizing the EOR delivery system 105. After this period of time, production of hydrocarbons from the reservoir may decline. If production declines below a margin that defeats profitability, then the EOR process is ceased, as shown in step 450, and the reservoir may be shut-in. If the production is above marginal production, then the process proceeds to step 460, which includes refurbishment of the EOR delivery system 105. Refurbishment may include pulling the downhole steam generator out of the wellbore, inspection, and replacement of worn parts of the generator. The packer may also be inspected and refurbished/replaced if needed during this step. Once the downhole steam generator and/or packer is serviced, the process may repeat steps 430 and 440.

Figure 5:
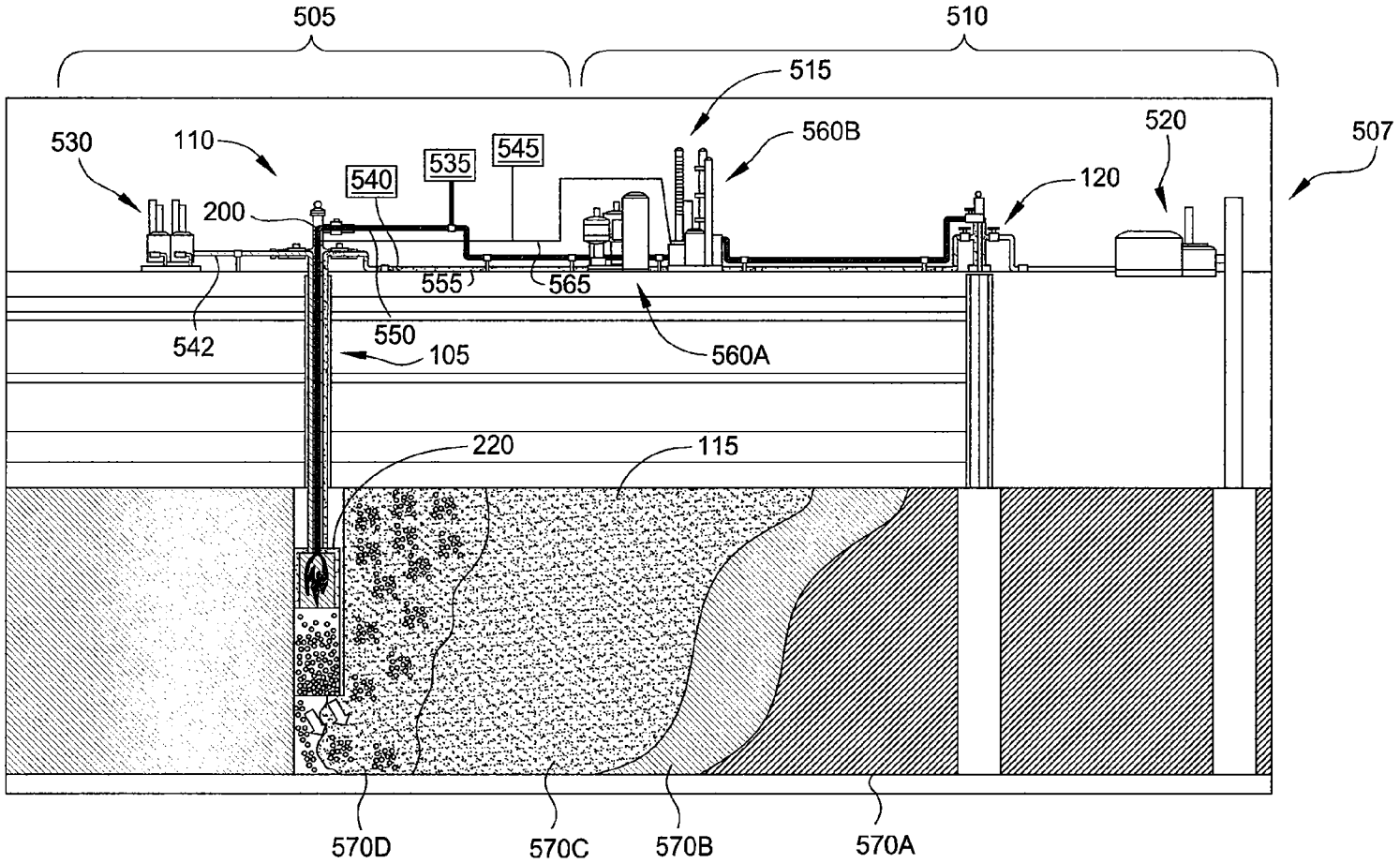
FIG. 5 is an elevation view of an EOR operation utilizing embodiments of the EOR delivery system of FIG. 2.

FIG. 5 is an elevation view of an EOR operation 500 utilizing embodiments of the EOR delivery system 105 as described herein. The EOR operation 500 includes a first surface facility 505, which includes the EOR delivery system 105 and a second surface facility 510. The first surface facility 505 includes an injector well 110 that is in communication with a reservoir 115. The second surface facility 510 comprises a first producer well 120 and a second producer well 507 that is in communication with the reservoir 115. The second surface facility 510 also includes associated production support systems, such as a treatment plant 515 and a storage facility 520. The first surface facility 505 may include a compressed gas source 530, a fuel source 535 and a steam precursor source 540 that are in selective fluid communication with a wellhead 200 of the injection well 110. The first surface facility 505 may also include a viscosity-reducing source 545 that is in selective communication with the wellhead 200.

In use, the EOR operation 500 may commence after the injector well 110 is drilled and the downhole steam generator 220 is positioned in the wellbore of the injector well 110 according to the installation/completion process 400 described in FIG. 4. Fuel is provided by the fuel source 535 to the downhole steam generator 220 by a conduit 550. Water is provided by the steam precursor source 540 to the downhole steam generator 220 by a conduit 555. An oxidant, such as air, enriched air (having about 35% oxygen), 95 percent pure oxygen, oxygen plus carbon dioxide, and/or oxygen plus other inert diluents may be provided from the compressed gas source 530 to the wellhead 200 by a conduit 542. The compressed gas source 530 may comprise an oxygen plant (e.g., one or more liquid $O_2$ tanks and a gasification apparatus) and one or more compressors.

The fuel source 535 and/or the steam precursor source 540 may be stand-alone storage tanks that are replenished on-demand during the EOR process. Alternatively, the fuel source 535 and/or the steam precursor source 540 may utilize on-site fluids, such as recycled water and combustible fluids from the oil produced from the reservoir 115. For example, the oil recovered from the producer well 120 may undergo a separation process in a separator unit to remove water and other fluids from the recovered oil. The recovered oil may be provided to a first treatment facility 560A where it is treated and flowed to the wellhead 200 through conduit 555. Excess water may be diverted and stored in the steam precursor source 540 until needed. Likewise, the oil recovered from the producer well 120 may be provided to a second treatment facility 560B. The second treatment facility 560B may be utilized to separate fluids, such as gases or liquids that may be used as fuel (e.g., hydrogen, natural gas, syngas). The second treatment facility 560B may also be equipped to separate the oil into fractions of gasoline or diesel for use as a fuel in the downhole steam generator 220. The recycled fuel fluid(s) may be flowed to the wellhead 200 through conduit 555. Excess fuel fluid(s) may be diverted and stored in the fuel source 535 until needed.

The viscosity-reducing source 545 may deliver injectants, such as viscosity reducing gases (e.g., $N_2$, $CO_2$, $O_2$, $H_2$), particles (e.g., nanoparticles, microbes) as well as other liquids or gases (e.g., corrosion inhibiting fluids) to the downhole steam generator 220 through the wellhead 200 through conduit 565. The viscosity-reducing source 545 may be an import pipeline and/or a stand-alone storage tank(s) that are replenished on-demand during the EOR process. Alternatively, the viscosity-reducing source 545 may be supplemented and/or replenished using recycled material from the oil produced in from the producer well 120. For example, the second treatment facility 560B may be configured to separate gases (e.g., viscosity-reducing gases) and/or particles from the recovered oil. The recovered gases and/or particles may be flowed to the wellhead 200 by conduit 565. Excess gases and/or particles may be diverted and stored in the viscosity-reducing source 545 until needed.

While not shown, the second producer well 507 may be in communication with the second surface facility 510 or have its own production support systems. Any recycled materials utilized by the first treatment facility 505 may be provided by oil recovered by one or both of the producer wells 120 and 507.

FIG. 5 also shows another embodiment of a reservoir management system provided by the EOR delivery system 105 as described herein. Starting from the side of the reservoir 115 adjacent the producer wells 120 and 507, zone 570A includes a volume of mobilized, reduced viscosity hydrocarbons. The reduced viscosity hydrocarbons are a result of viscosity-reducing gases in zone 570B and a high-quality steam front within zone 570C. Zone 570B comprises a volume of gas, such as $N_2$, $O_2$, $H_2$ and/or $CO_2$, in one embodiment, which mixes with the oil that is heated by steam from zone 570C. The steam front within zone 570C consists of high quality steam (e.g., up to 80 percent quality, or greater) and includes temperatures of about 100 degrees C. to about 300 degrees C., or greater. Adjacent the steam front is zone 570D, which comprises a residual oil oxidation front. Zone 570D comprises residual oil and excess oxygen.

The EOR operation 500 utilizing the EOR delivery system 105 as described herein enables a variety of different reservoir regimes. Additionally, the EOR delivery system 105 is highly configurable allowing EOR processes on a wide variety of reservoir types enabling recovery of about 30 percent to about 100 percent more oil than surface steam. One regime includes a high pressure process as described in FIG. 1. Another regime includes the embodiment of FIG. 5 where a residual oil oxidation and viscosity-reducing gases are utilized along with in-situ generated steam to enhance mobility of hydrocarbons for recovery by a plurality of production wells. The residual oil oxidation combined with high-quality steam and surplus oxygen enables a larger, more stable steam front while controlling oxygen breakthrough. Another regime provides for the use of the EOR delivery system 105 on steam assisted gravity drainage applications as described in FIG. 6.

Figure 6:
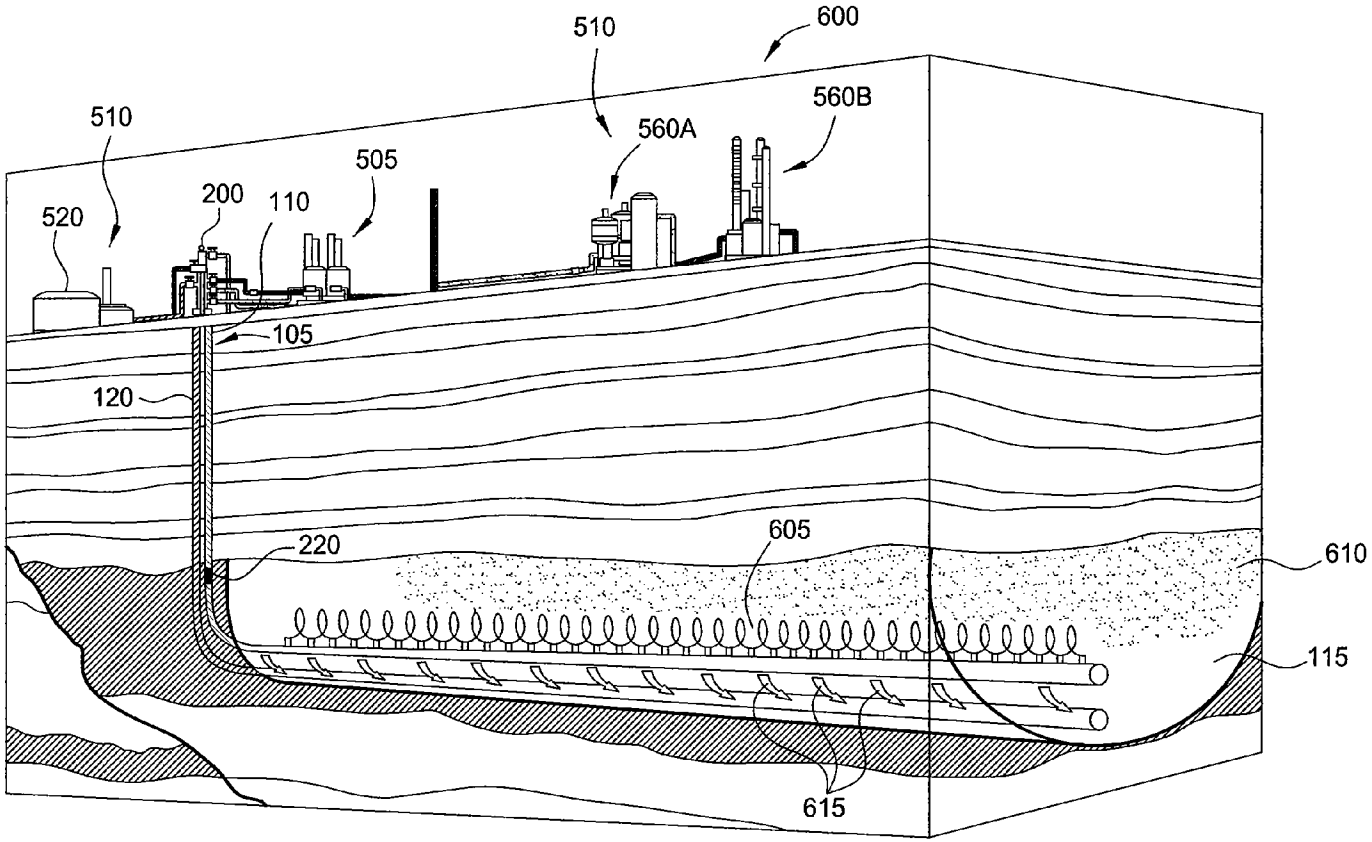
FIG. 6 is an isometric elevation view of another embodiment of an EOR operation.

FIG. 6 is an isometric elevation view of an EOR operation 600 utilizing embodiments of the EOR delivery system 105 as described herein. The EOR operation 600 includes a first surface facility 505, which includes the EOR delivery system 105. The EOR operation 600 also includes the second surface facility 510. The first surface facility 505 and the second surface facility 510 may be similar to the embodiment shown in FIG. 5 although in a different layout. The EOR operation 600 also includes an injector well 110 that is in communication with a reservoir 115 and a first producer well 120 that is in communication with the reservoir 115. The injector well 110 and the producer well 120 each have a wellbore with a horizontal orientation and horizontal portion of the producer well 120 is disposed below the injector well 110. The systems and subsystems of the first surface facility 505 and the second surface facility 510 of FIG. 5 may operate similarly and will not be described for brevity.

In use, the EOR operation 600 may commence after the injector well 110 is drilled and the downhole steam generator 220 is positioned in the wellbore of the injector well 110 according to the installation/completion process 400 described in FIG. 4. Fuel, water and an oxidant are provided to the downhole steam generator 220 from sources/conduits as described in reference to the EOR operation 500 of FIG. 5 in order to produce a steam front 605 in the reservoir 115. Likewise, viscosity-reducing gases and/or particles may be provided to the downhole steam generator 220. The viscosity-reducing gases and/or particles may be interspersed in the reservoir 115 (shown as shaded region 610) along with the steam front 605. The viscosity-reducing gases and/or particles reduce the viscosity in the hydrocarbons and the steam front 605 heats the reservoir 115 to enable mobilized oil 615 to be recovered by the producer well 120.

Figure 7:
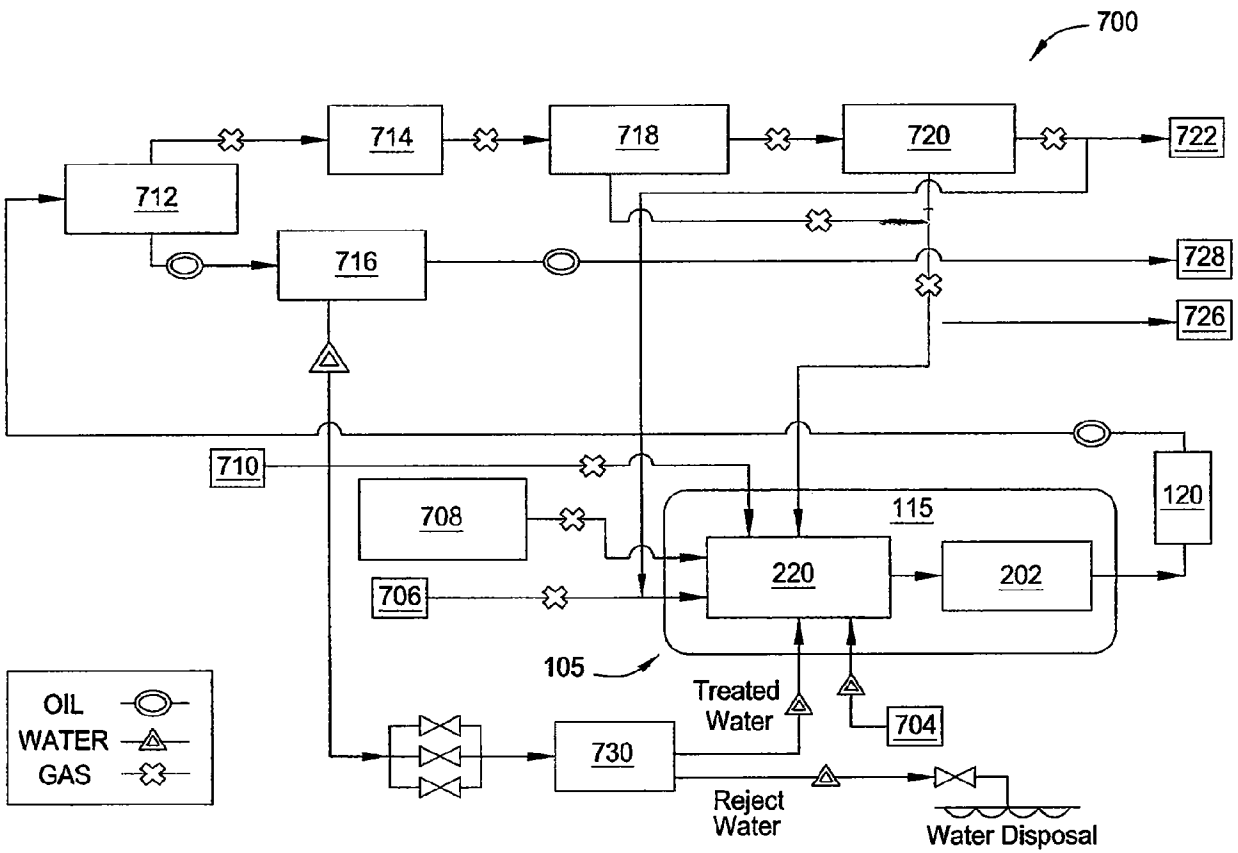
FIG. 7 is a schematic representation of one embodiment of an EOR infrastructure.

FIG. 7 is a schematic representation of one embodiment of an EOR infrastructure 700 that may be utilized with the EOR delivery system 105 as described herein. The infrastructure 700 may be utilized for production of hydrocarbons 702 from the reservoir 115 utilizing steam and $CO_2$ (as well as other viscosity-reducing gases). In a start-up process of the EOR delivery system 105, water from a water source 704 may be provided to the downhole steam generator 220 positioned in or near the reservoir 115. The water source 704 may be a storage tank and/or a water well. Fuel gas, oxidizing gases and CO2 may be provided to the downhole steam generator 220 from sources 706, 708 and 710, respectively. The water is converted to steam for the reservoir 115 as a combustion or vaporization product in the downhole steam generator 220. $CO_2$ may also be released into the reservoir 115 as a combustion product. The steam and $CO_2$ provide enhanced flow of hydrocarbons 702 in the reservoir 115 to produce oil through a producer well 120.

The recovered oil is flowed to a primary separator unit 712 from the producer well 120. The primary separator unit 712 processes the oil to separate gases and liquids. The gases are flowed to a dehydration unit 714 and the liquid is flowed to a liquid separator unit 716. The liquid separator unit 716 separates water from the liquid provided from the primary separator unit 712 and the dehydration unit 714 removes moisture from the gases provided from the primary separator unit 712. The gases may then be flowed to a first process unit 718 where bulk $N_2$ may be removed from the gases. Alternatively or additionally, the gases may be flowed to a second gas process unit 720 where $CO_2$ and/or $N_2$ may be removed from the gases. A fuel gas may be produced after treatment in one or more of the dehydration unit 714, the first gas process unit 718, and/or the second gas process unit 720. The fuel gas may include an energy content of about 220 British thermal units (BTU's) to about 300 BTU's, or greater, for example about 260 BTU's. The fuel gas may be directly utilized, marketed, or stored in a storage facility 722 and subsequently marketed. In one embodiment, a portion of the fuel gas is provided to the downhole steam generator 220 to facilitate steam generation. In embodiments where one or both of the first gas process unit 718 and the second gas process unit 720 are utilized, separated gases, such as $N_2$ and/or $CO_2$ may be provided to the EOR delivery system 105. The separated gases may include sour gas (e.g., gas containing significant amounts of hydrogen sulfide ($H_2S$)), an acid gas (e.g., a gas that contains significant amounts of acidic gases such as $CO_2$ and/or $H_2S$). Alternatively or additionally, surplus separated gases, such as $CO_2$, may be stored in a storage facility 726 and subsequently marketed or exported to adjacent oilfields for injection in another EOR process. Referring again to the liquid separator unit 716, recovered oil may be stored in a storage facility 728 and subsequently marketed. Alternatively, if the reservoir 115 is in fluid communication with a pipeline system, imported oil may be injected back into the reservoir 115. The injected oil may be utilized as a diluent in the produced fluids from the production wells serving reservoir 115. Water recovered from the oil may be recycled and provided to a water treatment unit 730 where the water is filtered, de-sanded, and processed. Treated water is provided to the downhole steam generator 220 for steam production while unsuitable water and filtered debris is disposed.

Figure 8:
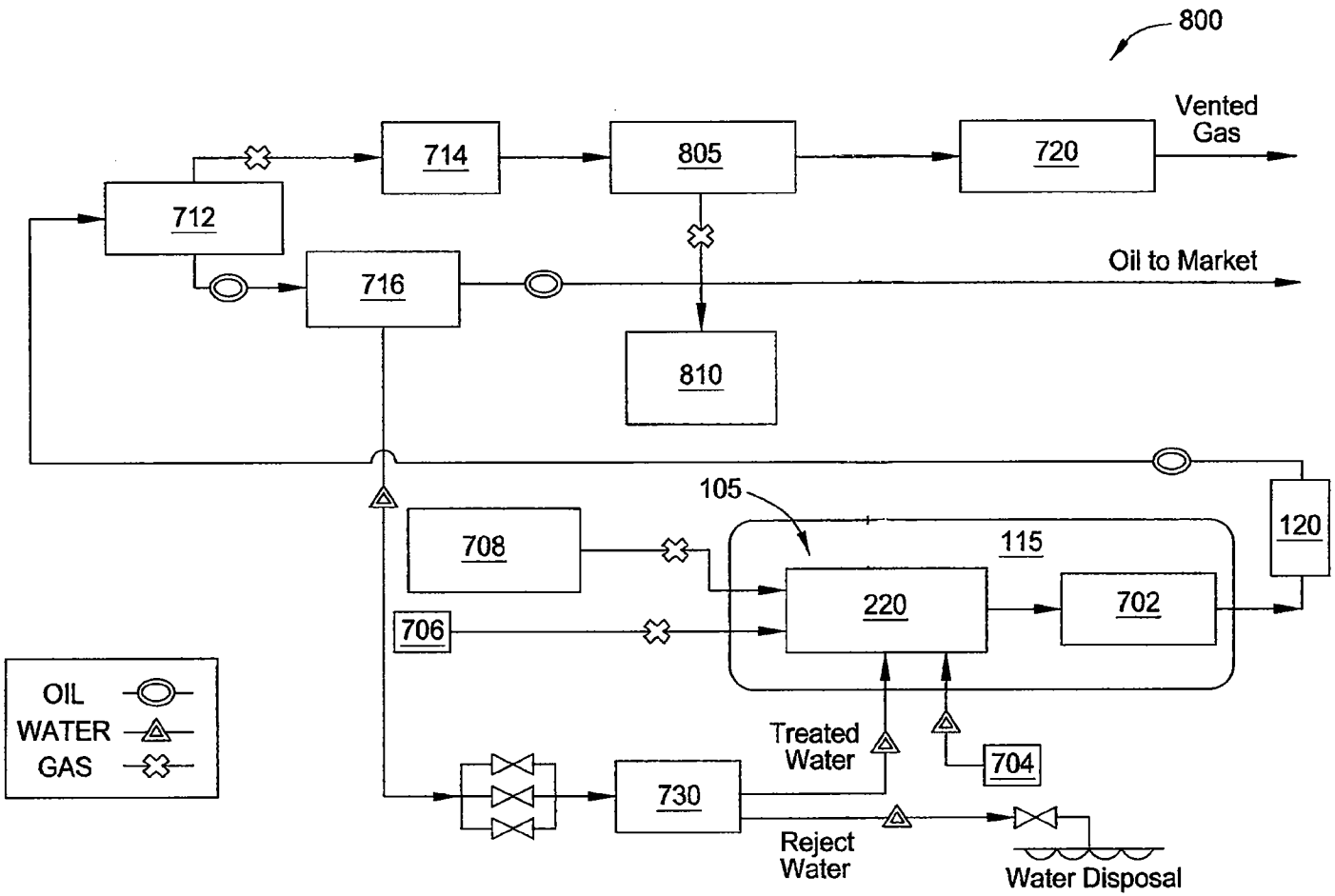
FIG. 8 is a schematic representation of another embodiment of an EOR infrastructure.

FIG. 8 is a schematic representation of another embodiment of an EOR infrastructure 800 that may be utilized with the EOR delivery system 105 as described herein. The infrastructure 800 may be utilized for production of hydrocarbons 702 in the reservoir 115 utilizing steam and $N_2$ (as well as other viscosity-reducing gases). The EOR infrastructure 800 may be used alone or in conjunction with the EOR infrastructure 700 shown in FIG. 7. The EOR infrastructure 800 includes elements and processes that may be similar to the EOR infrastructure 700 described in FIG. 7 and will not be described for brevity. However, some of the processes may be different, e.g., gas process unit 720 may be equipped to treat and incinerate produced gases before the gases are vented.

During operation of the EOR delivery system 105 as described in FIG. 7, oil is produced from the reservoir 115 and the recovered oil is flowed to the primary separator unit 712. The primary separator unit 712 processes the oil to separate gases and liquids as described in FIG. 7. The gases are flowed to a dehydration unit 714 and the liquid is flowed to a liquid separator unit 716. Water is separated from the oil in the liquid separator unit 716 and recovered oil is flowed as described in FIG. 7. Water is also recycled as described in FIG. 7. After dehydration of the gases in the dehydration unit 714, the gases may be flowed to a first gas process unit 805 that removes $H_2S$ from the gases. The $H_2S$ is then flowed to a treatment/storage facility 810 where solid sulfur is formed from the $H_2S$ gas. The remaining gases may be incinerated and vented.

While the foregoing is directed to embodiments of the invention, other and further embodiments of the invention may be implemented without departing from the scope of the invention, and the scope thereof is determined by the claims that follow.

The invention claimed is:

1. A method for recovery of hydrocarbons from a subterranean reservoir, the method comprising:

drilling an injector well to be in communication with a reservoir having one or more production wells in communication with the reservoir;

installing casing in the injector well;

cementing the casing;

perforating the casing;

positioning a downhole steam generator in the casing;

positioning a packer in the casing to bifurcate the casing into an upper volume and a lower volume, wherein the downhole steam generator is positioned in the upper volume of the casing;

flowing fuel, oxidant and water to the downhole steam generator to intermittently produce an exhaust gas in the reservoir;

flowing injectants to the reservoir; and producing hydrocarbons through the one or more production wells.

2. The method of claim 1, further comprising:

disposing a packer fluid in the upper volume of the casing.

3. The method of claim 2, wherein the packer fluid comprises a gas and a liquid.

4. The method of claim 2, further comprising:

circulating the packer fluid between the surface and the casing.

5. The method of claim 1, wherein the casing comprises a corrosion-resistant alloy casing.

6. The method of claim 5, wherein the corrosion-resistant alloy casing is disposed below the downhole steam generator.

7. The method of claim 1, wherein the injectants comprise one or a combination of a viscosity-reducing gas, nanoparticles, and microbes.

8. The method of claim 7, wherein the injectants are flowed to the reservoir when the exhaust gas is being produced by the downhole steam generator.

9. The method of claim 8, wherein the exhaust gas comprises steam.

10. The method of claim 7, wherein the injectants are flowed to the reservoir when the downhole steam generator is not producing the exhaust gas.

11. A system including surface facilities for recovering hydrocarbons, comprising:

at least one production well and an injector well in communication with a subterranean reservoir, each of the at least one production well and the injector well having a wellhead and a wellbore extending into the subterranean reservoir;

a first gas source and a second gas source positioned adjacent the injector well and coupled to a surface side of the wellhead of the injector well and in selective fluid communication with an inner bore of the wellbore of the injector well;

a fuel source and a water source positioned adjacent the injector well and coupled to the surface side of the wellhead of the injector well and in selective fluid communication with a downhole steam generator disposed in the inner bore of the wellbore of the injector well, wherein the downhole steam generator is coupled to an umbilical device having a plurality of conduits for delivery of fluids to the downhole steam generator and transmission of signals between the wellhead of the injector well, and wherein the downhole steam generator is coupled to a packer by a releasable latch mechanism.

12. The system of claim 11, wherein the first gas source comprises a viscosity reducing gas.

13. The system of claim 12, wherein the viscosity reducing gas comprises carbon dioxide, nitrogen, oxygen, hydrogen, and combinations thereof.

14. The system of claim 12, wherein the second gas source comprises a compressed oxidant.

15. The system of claim 11, further comprising:

a separation unit in fluid communication with the production well and the injector well.

16. The system of claim 15, wherein the separation unit separates a first gas from hydrocarbons recovered through the production well and provides the first gas to the first gas source.

17. The system of claim 16, wherein the first gas comprises a viscosity reducing gas.

18. The system of claim 15, wherein the separation unit separates water from hydrocarbons recovered through the production well and provides the water to the water source.

19. The system of claim 11, wherein the fuel source comprises a combustible gas produced from hydrocarbons recovered through the production well.

20. The system of claim 11, further comprising:

a connect/disconnect device configured to facilitate one or more connections between the umbilical device and the downhole steam generator.

21. A system including surface facilities for recovering hydrocarbons, comprising:

an injector well adjacent at least one production well extending into a subterranean reservoir;

a gas source positioned on the surface adjacent the injector well;

a fuel source and a water source in fluid communication with a burner assembly positioned in the injector well above a packer;

an umbilical device having a plurality of conduits for delivery of fluids to the burner assembly and a control conduit for transmission of signals between the surface and the burner assembly;

a separator unit in fluid communication with the production well and one or a combination of the fuel source and the water source to remove one of a gas or water from fluids flowing through the production well and flow the gas or water to the fuel source or the water source; and a latch mechanism disposed between the packer and the burner assembly configured to disconnect the burner assembly from the packer.

22. The system of claim 21, wherein the separation unit separates a gas from hydrocarbons recovered through the production well.

23. The system of claim 22, wherein the gas comprises a viscosity reducing gas.

24. The system of claim 22, wherein the gas comprises a fuel gas.

25. The system of claim 21, wherein the separation unit separates water from hydrocarbons recovered through the production well.

26. The system of claim 21, further comprising:

a connect/disconnect device configured to facilitate one or more connections between the umbilical device and the downhole steam generator.

* * * * *

UNITED STATES PATENT AND TRADEMARK OFFICE

CERTIFICATE OF CORRECTION

PATENT NO. : 8,733,437 B2
APPLICATION NO. : 13/560742
DATED : May 27, 2014
INVENTOR(S) : Ware, deceased et al.

It is certified that error appears in the above-identified patent and that said Letters Patent is hereby corrected as shown below:

On the Title Page, Inventors (75):

Please insert --deceased-- after Ware,;

In the Specification:

Column 4, Line 11, please delete "1358" and insert --135B-- therefor.

Signed and Sealed this
Ninth Day of September, 2014

Michelle K. Lee

Michelle K. Lee
*Deputy Director of the United States Patent and Trademark Office*